US012168950B2

(12) United States Patent
Brück et al.

(10) Patent No.: US 12,168,950 B2
(45) Date of Patent: Dec. 17, 2024

(54) ELECTRICAL CURRENT FEED-THROUGH

(71) Applicant: Vitesco Technologies GMBH, Regensburg (DE)

(72) Inventors: Rolf Brück, Bergisch Gladbach (DE); Philipp Langenfeld, Rösrath (DE); Marc Brugger, Neunkirchen-Seelscheid (DE); Katrin Konieczny, Much (DE); Lorenzo Pace, Rom (IT); Stefan Ahlers, Bergisch Gladbach (DE)

(73) Assignee: Vitesco Technologies GmbH, Regensburg (DE)

( * ) Notice: Subject to any disclaimer, the term of this patent is extended or adjusted under 35 U.S.C. 154(b) by 0 days.

(21) Appl. No.: 17/573,817

(22) Filed: Jan. 12, 2022

(65) Prior Publication Data

US 2022/0136422 A1 May 5, 2022

Related U.S. Application Data

(63) Continuation of application No. PCT/EP2020/067597, filed on Jun. 24, 2020.

(30) Foreign Application Priority Data

Jul. 12, 2019 (DE) ..... 10 2019 210 368.5

(51) Int. Cl.
*F01N 3/20* (2006.01)
*F01N 3/28* (2006.01)

(52) U.S. Cl.
CPC ..... *F01N 3/2026* (2013.01); *F01N 3/28* (2013.01); *F01N 2240/16* (2013.01); (Continued)

(58) Field of Classification Search
CPC .. F01N 2240/16; F01N 3/2026; F01N 3/2013; F01N 2510/02
See application file for complete search history.

(56) References Cited

U.S. PATENT DOCUMENTS 4,505,991 A 3/1985 Weber
5,670,746 A * 9/1997 Hashimoto ..... H01R 13/73 422/174

(Continued)

FOREIGN PATENT DOCUMENTS

CN 1258122 C 6/2000
DE 4435784 A1 4/1996

(Continued)

OTHER PUBLICATIONS

English Translation (Year: 2018).*

(Continued)

*Primary Examiner* — Anthony Ayala Delgado

(57) ABSTRACT

A current feed-through for an electrically heatable catalytic converter, wherein the catalytic converter has in the interior thereof at least one electrical conductor, which is electrically contactable by the current feed-through, having a central electrically conductive element, which is guided from the interior of the catalytic converter through the outer housing wall thereof, having an electrical insulation layer, which surrounds the electrically conductive element on its radial outer face, and having a metallic sleeve, in which the electrically conductive element and the electrical insulation layer is received, wherein at the current feed-through or directly adjacently to the current feed-through there is arranged a device for reducing the heat conduction from the interior of the catalytic converter along the current feed-through to a contact face arranged outside the catalytic converter.

6 Claims, 2 Drawing Sheets

(52) U.S. Cl.
CPC ..... *F01N 2260/02* (2013.01); *F01N 2260/20* (2013.01); *F01N 2510/02* (2013.01)

(56) References Cited

U.S. PATENT DOCUMENTS

| | | | | | |
|---|---|---|---|---|---|
| 5,744,104 | A * | 4/1998 | Sakurai | B01J 35/0033 422/174 |
| 5,904,903 | A | 5/1999 | Hotz | |
| 6,031,213 | A * | 2/2000 | Hashimoto | F01N 3/2026 422/174 |
| 6,060,699 | A * | 5/2000 | Sakurai | F01N 3/2026 219/205 |
| 6,176,081 | B1 * | 1/2001 | Shimasaki | F01N 3/2026 422/174 |
| 6,255,589 | B1 | 7/2001 | Starch | |
| 2012/0247090 | A1 | 10/2012 | Yoshioka et al. | |
| 2013/0312394 | A1 | 11/2013 | Yoshioka | |
| 2015/0083316 | A1 | 3/2015 | Shirai | |

FOREIGN PATENT DOCUMENTS

| | | | | |
|---|---|---|---|---|
| DE | 69501049 | T2 | 1/1998 | |
| DE | 69533609 | T2 | 10/2005 | |
| DE | 69732319 | T2 | 12/2005 | |
| DE | 102017216470 | A1 | 3/2019 | |
| JP | H05269387 | A | 10/1993 | |
| JP | H07328453 | A | 12/1995 | |
| JP | 0932533 | A | 2/1997 | |
| JP | 2015059080 | A | 3/2015 | |
| WO | WO-2019053250 | A1 * | 3/2019 | F01N 3/2013 |

OTHER PUBLICATIONS

Japanese Office Action dated Feb. 17, 2023 for corresponding Patent Application No. 2022-501353.
Chinese Office Action dated Jul. 29, 2023 for corresponding Patent Application No. 202080049435.9.
German Office Action dated Sep. 29, 2023 for corresponding German Patent Application No. 10 2019 210 368.5.

* cited by examiner

ELECTRICAL CURRENT FEED-THROUGH

CROSS-REFERENCE TO RELATED APPLICATIONS

This application claims priority to PCT Application PCT/EP2020/067597, filed Jun. 24, 2020, which claims priority to German Patent Application No. DE 10 2019 210 368.5, filed Jul. 12, 2019. The disclosures of the above applications are incorporated herein by reference.

FIELD OF THE INVENTION

The invention relates to a current feed-through for an electrically heatable catalytic converter, wherein the catalytic converter has in the interior thereof at least one electrical conductor, which is electrically contactable by the current feed-through, having a central electrically conductive element, which is guided from the interior of the catalytic converter through the outer housing wall thereof, having an electrical insulation layer, which surrounds the electrically conductive element on its radial outer face, and having a metallic sleeve, in which the electrically conductive element and the electrical insulation layer is received.

BACKGROUND OF THE INVENTION

Electrically heatable catalytic converters are known in the prior art. These generally have a conductor, through which a current is passed and which is connected to a voltage source by means of electrical contact. Since the catalytic converters are designed to be outwardly gas-tight, there are special electrical feed-throughs, which are guided through the outer casing of the catalytic converter and are contacted with the heating conductor in the interior.

The electrical feed-through consists here generally of an electrical conductor, which is embedded in an electrically non-conductive medium, for example a ceramic. The non-conductive material can in turn be surrounded by a metal sleeve, which by means of a joining technique can be connected to the metallic casing of the catalytic converter permanently and in a manner resistant to mechanical loads. The electrical feed-through, as is known in the prior art, thus usually has a central current conductor, for example a pin, a ceramic insulation, and a metallic outer sleeve.

A disadvantage of the current feed-throughs known in the prior art is in particular that, due to the integrally bonded connection between the current-conducting pin and the components in the interior of the catalytic converter that are to be electrically contacted, a high thermal load occurs in the outer region of the current feed-through. The thermal load is created either by convection of the exhaust-gas energy towards the current feed-through or by the heating of the heating conductor itself, which is in direct integrally bonded connection to the current feed-through. If the thermal loads are too high, this can lead, in particular at the contact region of the current feed-through in the outer region, to damage to the insulation of the electrical feed line or the connection means between the feed line and the current feed-through.

SUMMARY OF THE INVENTION

The object of the present invention is therefore to create a current feed-through for an electrically heatable catalytic converter which has a thermal decoupling of the outer contact-making region and the inner region of the catalytic converter around which the exhaust gas flows.

The object relating to the current feed-through is achieved by a current feed-through having the features described herein.

One exemplary embodiment of the invention relates to a current feed-through for an electrically heatable catalytic converter, wherein the catalytic converter has in the interior thereof at least one electrical conductor, which is electrically contactable by the current feed-through, having a central electrically conductive element, which is guided from the interior of the catalytic converter through the outer housing wall thereof, having an electrical insulation layer, which surrounds the electrically conductive element on its radial outer face, and having a metallic sleeve, in which the electrically conductive element and the electrical insulation layer is received, wherein at the current feed-through or directly adjacently to the current feed-through there is arranged a device for reducing the heat conduction from the interior of the catalytic converter along the current feed-through to a contact face arranged outside the catalytic converter.

The region of the current feed-through protruding into the catalytic converter is also referred to generally as a "hot end," since on the one hand the exhaust gas flowing through the catalytic converter contributes to a high temperature level, and on the other hand a high temperature level is generated by the energization of the electrical conductor itself in the interior of the catalytic converter.

The end of the current feed-through arranged outside the catalytic converter is also referred to as the "cold end", since much lower temperatures generally prevail here as compared to inside the catalytic converter.

In an embodiment, the cold end region, where for example the connection to a voltage source is produced, is sensitive to temperature. This is due firstly to the materials of the current conductors usually used, for example the insulation material of cables, and additionally to the selected connection method, for example soldering, crimping or spring clamping, between the current conductor and the contact face of the current feed-through.

A device for reducing the heat conduction from the hot end to the externally arranged cold end serves here to keep the heat energy inside the catalytic converter or at least to keep to a minimum the heat transported outwardly along the current feed-through.

It is also expedient if the electrically conductive element is formed by a pin. In an embodiment, the pin has a round cross section. The insulation layer and the metal sleeve is arranged concentrically with the pin.

In an embodiment, the device is formed by at least one portion of reduced thermal conductivity at the electrically conductive element. The heat conductivity reduced at least at one portion prevents the largest possible amount of the heat introduced at the hot end into the current feed-through from being transported to the cold end. For example, a thermally insulating material is selected for this purpose, which has a lower thermal conductivity than the electrically conductive element.

In an embodiment, the device is formed by a heat shield. A heat shield serves to shield against heat convection.

An exemplary embodiment is characterized in that the heat shield is arranged on the outer side of the housing wall to shield the contact face. Such a heat shield is intended to prevent the heat radiation from the current feed-through itself, but also from the housing of the catalytic converter in the direction of the cold end. The heat shield is arranged, for example, in the manner of a rosette around the current feed-through.

In an embodiment, the heat shield is arranged on the inner side of the housing wall. A heat shield on the inner side of the housing wall serves the purpose of reducing the transfer of heat from the flowing exhaust gas to the current feed-through and to the housing regions surrounding the latter. In an embodiment, a heat shield arranged inside the catalytic converter is arranged in the form of a rosette around the current feed-through.

In addition, in an embodiment, the device is formed by an additional thermal mass, which is thermally connected to the current feed-through. An additional thermal mass is formed by a body of larger mass and serves to absorb and temporarily store the heat energy.

In an embodiment, the device is formed by an individual cooling rob or a plurality of cooling ribs, which is/are thermally connected to the current feed-through. Cooling ribs serve to transport heat away from the current feed-through and into the surrounding environment. The cooling ribs are arranged here on the portion of the current feed-through disposed outside the housing the catalytic converter.

In an embodiment, the device is formed by an electrically conductive element, which has a significantly reduced diameter at least in some portions.

Here, a material which for example has a lower specific resistance may be selected in some portions. Due to the low diameter, the heat conduction is reduced, wherein, on account of the adjustment of the specific resistance, the electrical conductivity on the whole is not compromised.

It is also expedient if the device is formed by an extended electrically conductive element. In an embodiment, the extension of the electrically conductive element beyond the amount that is necessarily required results in the path over which heat is delivered from the current feed-through back into the surrounding environment is thus increased. The temperature level at the cold end may thus also be reduced. The extension describes a longer design than would be provided as standard.

In an embodiment, the device is formed by a segment of the current feed-through in which a phase change of a material is executed in order to convert thermal energy. A segment in which a phase change of a material is performed, for example the evaporation of water, causes thermal energy to be likewise removed and therefore the temperature level in the region of the current feed-through is reduced.

Various embodiments of the present invention are described in the following description of the figures.

BRIEF DESCRIPTION OF THE DRAWINGS

The invention will be discussed in more detail below on the basis of exemplary embodiments with reference to the drawings. In the drawings.

DETAILED DESCRIPTION OF THE PREFERRED EMBODIMENTS

The following description of the preferred embodiment(s) is merely exemplary in nature and is in no way intended to limit the invention, its application, or uses.

Figure 1:
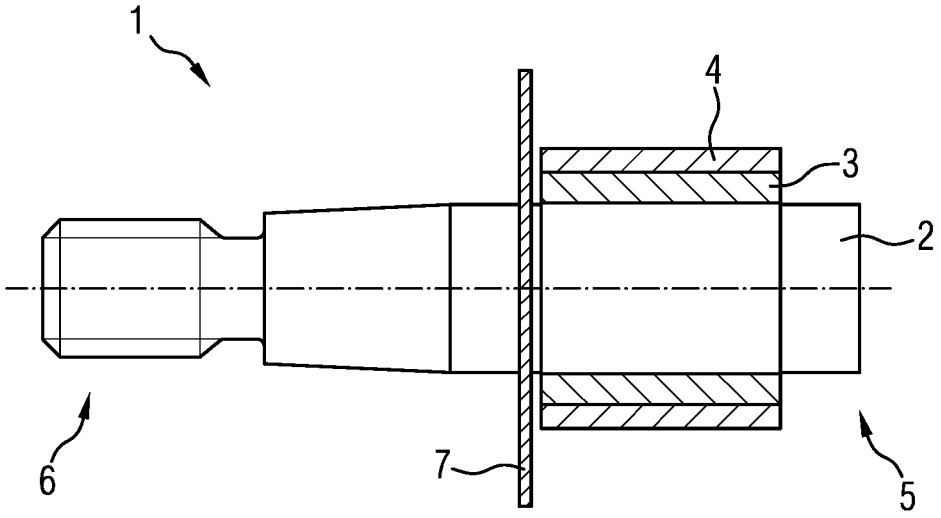
FIG. 1 shows a view of a current feed-through with a heat shield.

FIG. 1 shows a current feed-through 1. This is formed from an electrically conductive pin 2, which is surrounded at least in some portions by an electrically non-conductive insulation layer 3. In the region of the insulation layer 3 there is additionally arranged a metallic sleeve 4, in which the electrically conductive pin 2 and the insulation layer 3 are received.

The right-hand end 5 of the pin 2 forms what is known as the hot end, which protrudes into the catalytic converter (not shown) and is in electrically conductive contact with the electrical conductor in the catalytic converter. The left end 6 forms what is known as the cold end, which forms the contact region outside the catalytic converter.

Furthermore, the heat shield 7 is seen, which is arranged on the side of the metal sleeve 4 and the insulation layer 3 facing the cold end 6. The heat shield 7 serves to reduce the heat radiation from the catalytic converter (not shown) and from the direction of the hot end 5 of the current feed-through 1. The heat shield 7 is formed for example by a metal sheet. Alternatively or additionally, it may also be a thermally insulating material.

Figure 2:
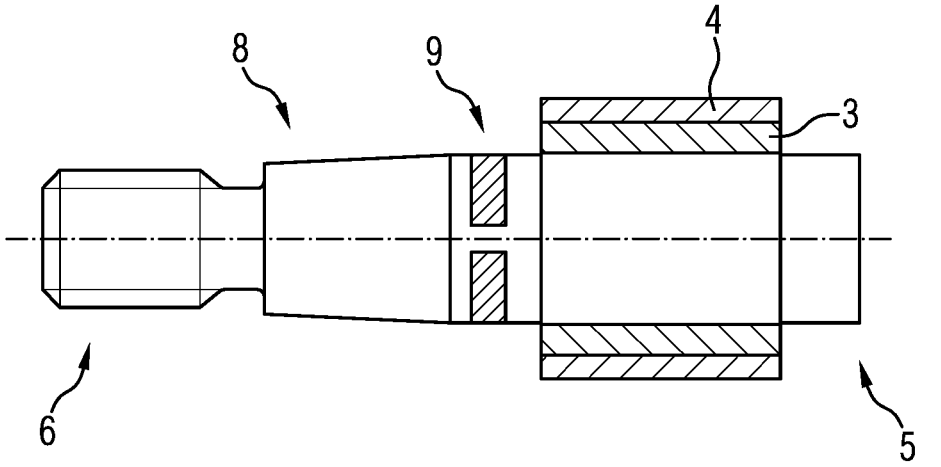
FIG. 2 shows a view of a current feed-through with a diameter that is reduced in some portions.

FIG. 2 shows an alternative embodiment of the current feed-through 8, wherein the current feed-through 8 has a region of reduced diameter 9. For example, a material of low specific electrical resistance is used in this region 9, so that the same electrical conductivity is achieved, in spite of the modified diameter. The region of smaller diameter 9 is likewise arranged on the side of the current feed-through 8 facing the cold end 6. A further possibility here would be to save the material of the current feed-through 1 at a point 9 and to fill the created groove with an alternative material which has a lower thermal conductivity and an equivalent electrical conductivity.

Figure 3:
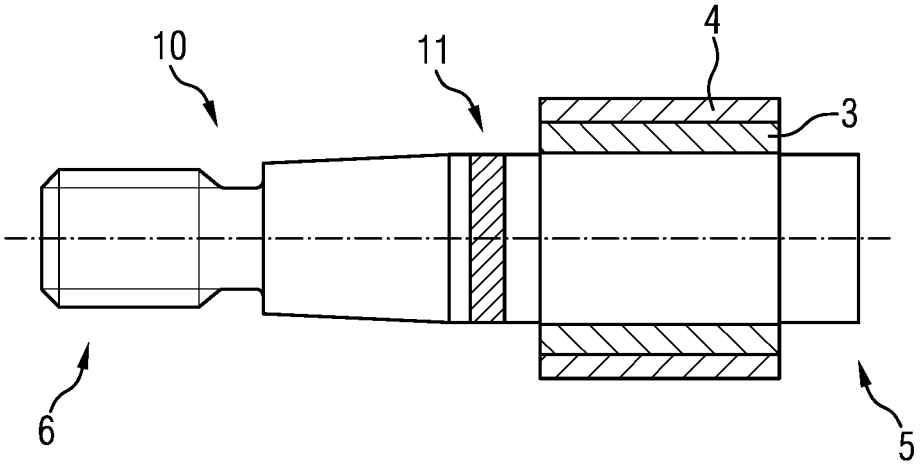
FIG. 3 shows a view of a current feed-through with a segment of reduced thermal conductivity.

FIG. 3 shows a further alternative embodiment of a current feed-through 10, wherein in this exemplary embodiment there is formed a segment 11 of reduced thermal conductivity. For this purpose, for example, a material deviating from the rest of the pin is used to produce this segment.

The different features of the individual exemplary embodiments may also be combined with one another. The exemplary embodiments in FIGS. 1 to 3 are not of a limiting nature and serve for illustrating the concept of the invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A current feed-through for an electrically heatable catalytic converter, wherein the catalytic converter has in the interior thereof at least one electrical conductor, which is electrically contactable by the current feed-through, the current feed-through comprising:

a central electrically conductive element having a hot end and a cold end, which is guided from the interior of the catalytic converter through an outer housing wall of the catalytic converter;

an electrical insulation layer which surrounds the central electrically conductive element on a radial outer face of the central electrically conductive element;

a metallic sleeve in which the central electrically conductive element and the electrical insulation layer are received, the electrical insulation layer and the metallic sleeve mounted to the hot end of the central electrically conductive element; and a device for reducing the heat conduction from the interior of the catalytic converter along the current feed-through to a contact face arranged outside the catalytic converter, the device further comprising:

at least one portion of reduced thermal conductivity made of a different material than the electrically conductive element;

wherein the device is located between the hot end and the cold end, such the device is adjacent to the electrical insulation layer and the metallic sleeve.

2. The current feed-through of claim 1, the central electrically conductive element further comprising a pin.

3. A current feed-through for an electrically heatable catalytic converter, wherein the catalytic converter has in the interior thereof at least one electrical conductor, which is electrically contactable by the current feed-through, the current feed-through comprising:

a central electrically conductive element having a hot end and a cold end, which is guided from the interior of the catalytic converter through an outer housing wall of the catalytic converter;

an electrical insulation layer which surrounds the central electrically conductive element on a radial outer face of the central electrically conductive element;

a metallic sleeve in which the central electrically conductive element and the electrical insulation layer are received, the electrical insulation layer and the metallic sleeve mounted to the hot end of the central electrically conductive element; and a device for reducing the heat conduction from the interior of the catalytic converter along the current feed-through to a contact face arranged outside the catalytic converter, the device further comprising:

a heat shield;

wherein the heat shield is connected to an area of the radial outer face of the central electrically conductive element between the hot end and the cold end, such the heat shield is adjacent to the electrical insulation layer and the metallic sleeve.

4. The current feed-through of claim 3, wherein the heat shield is arranged on the outer side of the housing wall to shield the contact face.

5. The current feed-through of claim 3, wherein the heat shield is arranged on the inner side of the housing wall.

6. A current feed-through for an electrically heatable catalytic converter, wherein the catalytic converter has in the interior thereof at least one electrical conductor, which is electrically contactable by the current feed-through, the current feed-through comprising:

a central electrically conductive element having a hot end and a cold end, which is guided from the interior of the catalytic converter through an outer housing wall of the catalytic converter;

an electrical insulation layer which surrounds the central electrically conductive element on a radial outer face of the central electrically conductive element;

a metallic sleeve in which the central electrically conductive element and the electrical insulation layer are received, the electrical insulation layer and the metallic sleeve mounted to the hot end of the central electrically conductive element; and a device for reducing the heat conduction from the interior of the catalytic converter along the current feed-through to a contact face arranged outside the catalytic converter, the device further comprising:

a region of the central electrically conductive element having a significantly reduced diameter, at least in some portions, the region being a groove;

a material disposed in the region having a low thermal conductivity;

wherein the device is located between the hot end and the cold end, such the device is adjacent to the electrical insulation layer and the metallic sleeve.

* * * * *